US010353333B2

(12) United States Patent
Esumi

(10) Patent No.: US 10,353,333 B2
(45) Date of Patent: Jul. 16, 2019

(54) IMAGE FORMING APPARATUS, EXPOSURE POSITION CORRECTING METHOD, PROGRAM, AND METHOD OF MANUFACTURING TEST CHART FORMATION MEDIUM

(71) Applicant: KONICA MINOLTA, INC., Tokyo (JP)

(72) Inventor: Yoshihiro Esumi, Tokyo (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/157,445

(22) Filed: Oct. 11, 2018

(65) Prior Publication Data

US 2019/0129341 A1 May 2, 2019

(30) Foreign Application Priority Data

Oct. 27, 2017 (JP) ..... 2017-207712

(51) Int. Cl.
*G03G 15/00* (2006.01)
*G03G 15/04* (2006.01)
*G03G 15/043* (2006.01)

(52) U.S. Cl.
CPC ..... *G03G 15/5062* (2013.01); *G03G 15/043* (2013.01); *G03G 15/04045* (2013.01)

(58) Field of Classification Search
CPC ..... G03G 15/5062; G03G 15/043; G03G 15/04045
See application file for complete search history.

(56) References Cited

U.S. PATENT DOCUMENTS

2007/0268358 A1* 11/2007 Noguchi ..... G03G 15/0131 347/261
2008/0069602 A1* 3/2008 Miyadera ..... G03G 15/0194 399/301

FOREIGN PATENT DOCUMENTS

JP 2002267961 A 9/2002
JP 2012189864 A * 10/2012

* cited by examiner

*Primary Examiner* — Susan S Lee
(74) *Attorney, Agent, or Firm* — Buchanan Ingersoll & Rooney PC

(57) ABSTRACT

An image forming apparatus includes: a photoreceptor; a light source; a rotational polygon mirror including a plurality of mirror surfaces on an outer circumferential surface of a rotating body; and a hardware processor that: controls the light source to perform emission of a light beam; controls to rotate the rotational polygon mirror to perform a sequential primary scanning; and corrects a shift of an exposure position of the light beam; and a clock characteristic changer capable of changing a clock characteristic including at least one of frequency and phase of a write clock, wherein the hardware processor controls to execute two-dimensional exposure with the clock characteristic of the write clock, controls to execute the two-dimensional exposure at a predetermined relative position with respect to the mirror surface, and specifies a mirror surface used for formation of each portion of the detection pattern.

9 Claims, 11 Drawing Sheets

IMAGE FORMING APPARATUS, EXPOSURE POSITION CORRECTING METHOD, PROGRAM, AND METHOD OF MANUFACTURING TEST CHART FORMATION MEDIUM

The entire disclosure of Japanese patent Application No. 2017-207712, filed on Oct. 27, 2017, is incorporated herein by reference in its entirety.

BACKGROUND

Technological Field

The present invention relates to an image forming apparatus, an exposure position correcting method, a program, and a method of manufacturing a test chart formation medium.

Description of the Related Art

Conventionally, there is an image forming apparatus of an electrophotographic system that first exposes a surface of a charged photoreceptor to form an electrostatic latent image and then transfers a toner image obtained as a result of developing the electrostatic latent image to a recording medium to form an image. Among methods of exposing the surface of the photoreceptor, there is a widely used method of emitting a light beam modulated on the basis of image data to a rotational polygon mirror while rotating the photoreceptor to move the surface of the photoreceptor in a secondary scanning direction and then sequentially scanning light beams reflected on each of a plurality of mirror surfaces of a rotational polygon mirror onto the surface of the photoreceptor in a primary scanning direction.

Irregularities on the mirror surface of the rotational polygon mirror or unevenness in the rotation speed of the mirror surface would cause a shift in exposure positions of the light beam reflected on the mirror surface. The shift in the exposure position corresponding to the state of the mirror surface repeatedly occurs in a rotation cycle of the rotational polygon mirror, leading to a cyclic position shift in dots appearing in an image formed. This cyclic position shift in dot interferes with a screen processing pattern or the like to be visually recognized as deterioration in image quality such as streaks.

To cope with this, JP 2002-267961 A discloses a technique of first measuring a scanning time from a start timing and an end timing of scanning on each of mirror surfaces of a rotational polygon mirror, and then adjusting a write clock of a light beam in accordance with the obtained scanning time on each of the mirror surfaces so as to correct the exposure position shift in the primary scanning direction.

There is another technique of highly accurately measuring the mirror surface shape and rotation speed of the rotational polygon mirror at manufacture and installation of the rotational polygon mirror to correct the exposure position shift beforehand.

The technique described in JP 2002-267961 A, however, has difficulty in accurately correcting a non-linear shift, if any, in the exposure position within a primary scanning range (within an image forming region). In addition, this technique has difficulty in detecting and correcting a shift in the exposure position in the secondary scanning direction in the presence of surface tilt of the mirror surface or the like. In this manner, the technique disclosed in JP 2002-267961 A has a problem of difficulty in accurately correcting the shift in a certain direction of the exposure position at each of positions in the image forming region.

In addition, irregularities of the mirror surface of the rotational polygon mirror might change with time due to continuous centrifugal force or the like, and unevenness of the rotation speed of the mirror surface might also change with time due to characteristic changes of the motor, or the like. Therefore, this technique includes a problem that with correction of the exposure position shift at the time of manufacturing or installation, it is difficult to correct a subsequent shift in the exposure position caused by irregularities of the mirror surface and a change with time in the rotation speed.

In this manner, the conventional technique described above has a problem that it is difficult to detect and accurately correct the subsequent shift in the exposure position occurring at a certain position in the image forming region.

SUMMARY

An object of the present invention is to provide an image forming apparatus, an exposure position correction method, a program, and a method of manufacturing a test chart formation medium, capable of further accurately correct a subsequent shift in the exposure position.

To achieve the abovementioned object according to an aspect of the present invention, an image forming apparatus reflecting one aspect of the present invention comprises:

a photoreceptor;

a light source;

a rotational polygon mirror including a plurality of mirror surfaces on an outer circumferential surface of a rotating body that rotates around a predetermined rotation axis and being provided to achieve a configuration to execute sequential primary scanning in which a light beam is emitted from the light source to the rotating outer circumferential surface, and the light beam reflected on each of the plurality of mirror surfaces sequentially scans over a surface of the photoreceptor in a predetermined primary scanning direction: and a hardware processor that:

controls the light source to perform emission of the light beam modulated on the basis of image data in accordance with a write clock;

controls to rotate the rotational polygon mirror to perform the sequential primary scanning with the modulated light beam while moving the surface of the charged photoreceptor in a secondary scanning direction intersecting the primary scanning direction so as to control to execute two-dimensional exposure of the surface of the photoreceptor to form an electrostatic latent image of an image related to the image data; and corrects a shift of an exposure position of the light beam arising in accordance with a state of each of the plurality of mirror surfaces; and a clock characteristic changer capable of changing a clock characteristic including at least one of frequency and phase of the write clock, wherein the hardware processor controls to execute the two-dimensional exposure with the clock characteristic of the write clock used for the scanning on one mirror surface among the plurality of mirror surfaces differentiated from the clock characteristic of the write clock used for the scanning with another mirror surfaces so as to form an electrostatic latent image of a mirror surface specifying pattern capable of specifying a reference portion formed in the scanning over the one mirror surface, controls to execute the two-dimensional exposure at a predetermined relative position with respect to the mirror surface specifying pattern with a predetermined clock characteristic so as to form an electrostatic latent image of a detection pattern for detecting the shift, and specifies a mirror surface used for formation of each portion of the detection pattern from a positional relationship between the reference portion and the detection pattern on the basis of a reading result of a recording medium on which a test chart is formed, the test chart being obtained by developing the electrostatic latent image of the mirror surface specifying pattern and the detection pattern, and detects and corrects the shift related to each of the plurality of mirror surfaces on the basis of a specifying result of the mirror surface and the detection pattern.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the image forming apparatus, an exposure position correcting method, a program, and a method of manufacturing a test chart formation medium according to the present invention will be described with reference to the drawings. However, the scope of the invention is not limited to the disclosed embodiments.

<Configuration of Image Forming Apparatus>

Figure 1:
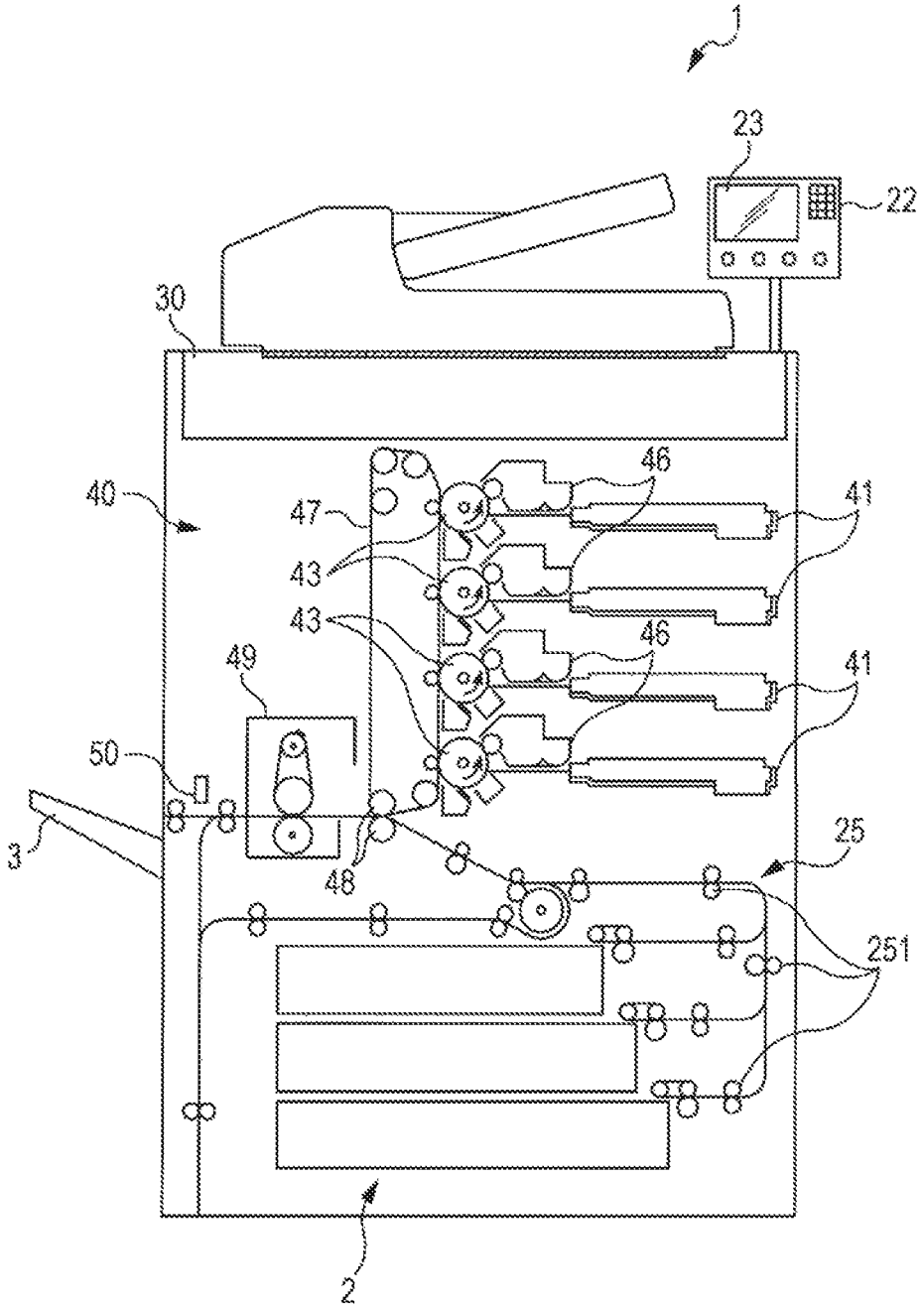
FIG. 1 is a schematic diagram illustrating a schematic configuration of an image forming apparatus.

FIG. 1 is a schematic diagram illustrating a schematic configuration of an image forming apparatus 1 according to an embodiment of the present invention.

Figure 2:
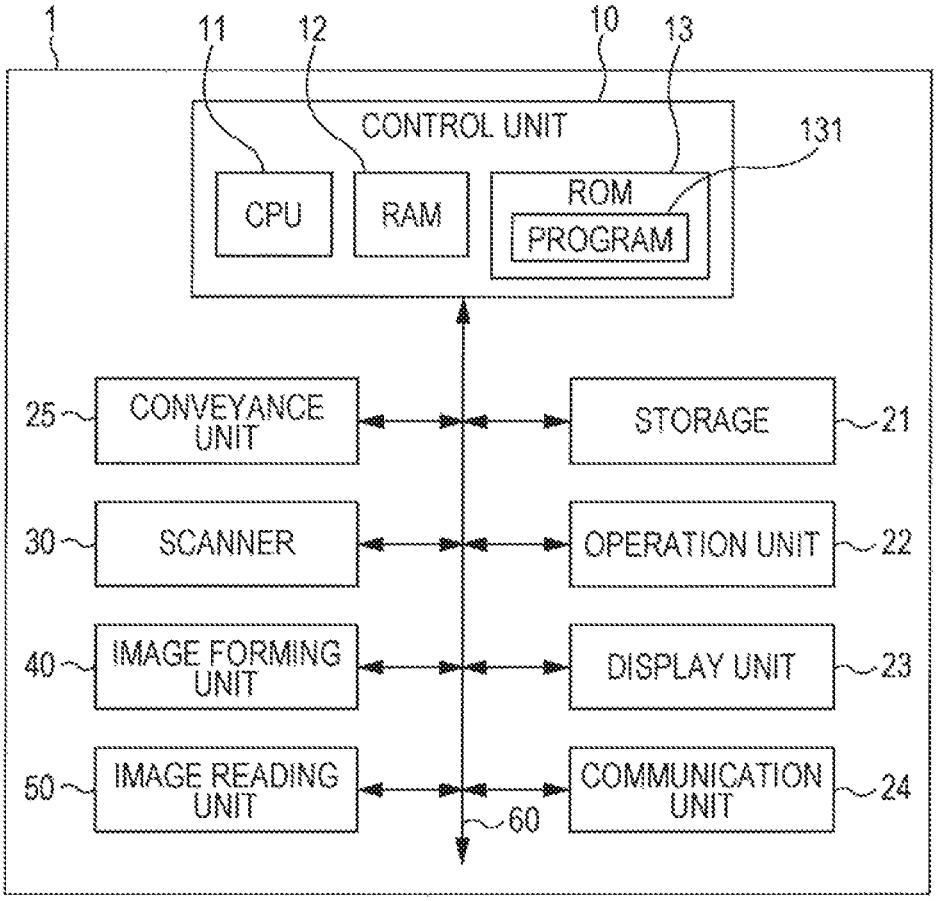
FIG. 2 is a block diagram illustrating a main functional configuration of an image forming apparatus.

FIG. 2 is a block diagram illustrating a main functional configuration of an image forming apparatus 1.

The image forming apparatus 1 includes a recording medium supply unit 2, a recording medium discharge unit 3, a control unit 10 (a light source control unit, an exposure control unit, a correction unit, and a computer), a storage 21, an operation unit 22, a display unit 23, a communication unit 24, a conveyance unit 25, a scanner 30, an image forming unit 40, an image reading unit 50 (reader), and a bus 60. These individual units are mutually connected via the bus 60.

The image forming apparatus 1 conveys a recording medium such as a sheet stored in the recording medium supply unit 2 by a conveyance roller 251 of the conveyance unit 25 and causes the image forming unit 40 to form an electrophotographic image on the conveyed recording medium and discharges the formed image to the recording medium discharge unit 3.

The control unit 10 includes a central processing unit (CPU) 11, a random access memory (RAM) 12, and a read only memory (ROM) 13.

The CPU 11 reads out and executes a program 131 stored in the ROM 13 to perform various arithmetic processing.

The RAM 12 provides the CPU 11 with a working memory space and stores temporary data.

The ROM 13 stores the program 131 to be executed by the CPU 11, setting data, or the like. It is allowable to use a rewritable nonvolatile memory such as an electrically erasable programmable read only memory (EEPROM) or a flash memory, instead of the ROM 13.

The control unit 10 including these CPU 11, RAM 12, and ROM 13 collectively controls individual units of the image forming apparatus 1 in accordance with the program 131. For example, the control unit 10 causes the conveyance unit 25 to convey the recording medium, and causes the image forming unit 40 to form an image on the recording medium on the basis of the image data stored in the storage 21. In addition, the control unit 10 performs exposure position correction processing on the basis of a reading result of a predetermined test chart using a method described below.

The storage 21 is constituted with a dynamic random access memory (DRAM) or the like, and stores image data obtained by the scanner 30, image data input from the outside via the communication unit 24, or the like. The data and information may be stored in the RAM 12.

The operation unit 22 includes input devices such as operation keys and a touch screen arranged over the screen of the display unit 23 and configured to convert input operation performed onto these input devices into an operation signal and output the operation signal to the control unit 10.

The display unit 23 includes a display apparatus such as a liquid crystal display (LCD). Under the control of the control unit 10, the display unit 23 displays a state of the image forming apparatus 1, an operation screen including operation buttons used for input operation to the touch screen, or the like.

Under the control of the control unit 10, the communication unit 24 communicates with computers and other image forming apparatuses on the network to transmit and receive image data, print job data, or the like.

The conveyance unit 25 includes a plurality of conveyance rollers 251 that rotates while holding the recording medium so as move the recording medium, and rotationally drives the conveyance roller 251 under the control of the control unit 10 so as to convey the recording medium along a predetermined conveyance path.

Under the control of the control unit 10, the scanner 30 reads a surface of the recording medium mounted on the predetermined recording medium mounting table by the user to generate image data, and stores the generated image data in the storage 21.

Under the control of the control unit 10, the image forming unit 40 forms an image on the recording medium on the basis of the image data stored in the storage 21. The image forming unit 40 includes a drum-shaped photoreceptor 43 (image bearing member) whose surface is charged by a charging roller (not illustrated): a light source 41 that emits a laser beam (light beam) to the surface of the charged photoreceptor 43 for exposure to form an electrostatic latent image on a surface of the photoreceptor 43; a developing unit 46 that develops the electrostatic latent image with a developer containing toner to form a totter image on the surface of the photoreceptor 43; an intermediate transfer belt 47 onto which the formed toner image is primarily transferred; a transfer unit 48 that performs secondary transfer of the toner image from the intermediate transfer belt 47 to the recording medium; and an image fixing unit 49 that heats and pressurizes the recording medium to which the toner image has been transferred to fix the toner image on the recording medium. Among the above, an imaging unit including the light source 41, the photoreceptor 43, and the developing unit 46 is provided as four sets each corresponding to each of colors of yellow (Y), magenta (M), cyan (C) and black (K), being arranged in the order of Y. M. C, and K along the intermediate transfer belt 47.

Under the control of the control unit 10, the image reading unit 50 reads a surface of the recording medium including an image formed by the image forming unit 40, generates image data, and stores the generated image data in the storage 21. The image reading unit 50 is provided on a downstream side of the image forming unit 40 in the conveying direction of the recording medium, and reads the surface of the recording medium before the recording medium is discharged to the recording medium discharge unit 3 (that is, inline). The image reading unit 50 can be a line sensor capable of imaging over a width of the recording medium in a width direction orthogonal to the conveying direction of the recording medium, for example.

<Configuration and Operation of Image Forming Unit>

Next, the detailed configuration and operation of the image forming unit 40 will be described.

Figure 3:
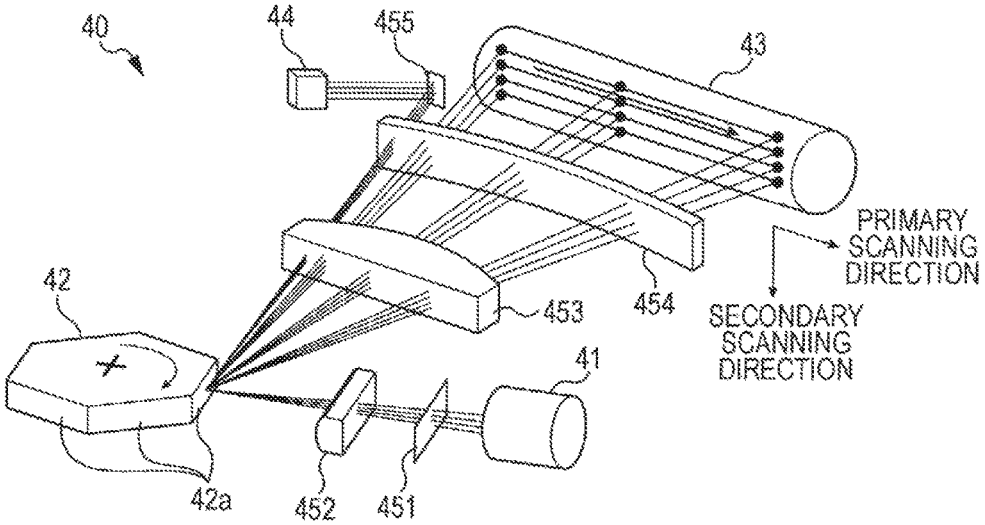
FIG. 3 is a schematic diagram illustrating constituent elements related to formation of an electrostatic latent image in an image forming unit.

FIG. 3 is a schematic diagram illustrating components related to formation of an electrostatic latent image in the image forming unit 40.

The image forming unit 40 includes a laser beam light source 41, a slit 451, a collimator lens 452, a polygon mirror 42 (rotational polygon mirror), an f) lens 453, a cylindrical lens 454, a photoreceptor 43, a mirror 455, and a synchronization sensor 44.

The light source 41 is a multi beam light source having a plurality of light emitting elements, and emits a laser beam from each of the plurality of light emitting elements, making it possible to emit a plurality of (four in the present embodiment) laser beams in parallel. The light source 41 can be formed with a semiconductor laser array or the like.

The slit 451 shapes each of laser beams emitted from the light source 41 into a predetermined spot diameter.

The collimator lens 452 converts the laser beam transmitted through the slit 451 into parallel light.

The polygon mirror 42 includes a plurality of (six in the present embodiment) mirror-like polygon surfaces 42*a* (mirror surface) on an outer circumferential surface of a rotating body of a regular polygonal columnar body (regular hexagonal prism body in the present embodiment) and rotates around a rotation axis (rotationally symmetric axis of the regular polygonal columnar body) parallel to each of the polygon surfaces 42*a*. The polygon mirror 42 causes the laser beam converted into parallel light to be reflected on each of the polygon surfaces 42*a* and guided to the photoreceptor 43. The laser beam is deflected by the rotation of the polygon mirror 42 and scans over the photoreceptor 43 along an axial direction of the photoreceptor 43. The laser beam scanning direction is a primary scanning direction, while the direction intersecting (orthogonal in the present embodiment) the primary scanning direction on the photoreceptor 43 is a secondary scanning direction. In this manner, the polygon mirror 42 receives a laser beam on its rotating outer circumferential surface and allows the laser beam to be reflected on each of the plurality of polygon surfaces 42*a* and to sequentially scan over the surface of the photoreceptor 43 in the primary scanning direction, that is, being configured to perform sequential primary scanning. Furthermore, execution of the above-described sequential primary scanning while rotating the photoreceptor 43 to move the surface of the photoreceptor 43 in a secondary scanning direction leads to execution of two-dimensional exposure of the surface of the charged photoreceptor 43. Hereinafter, the six polygon surfaces 42*a* of the polygon mirror 42 will be referred to as a first polygon surface to a sixth polygon surface.

The fθ lens 453 is disposed on an optical path between the polygon mirror 42 and the photoreceptor 43, and equalizes the scanning speed of the laser beam scanning the surface of the photoreceptor 43.

The cylindrical lens 454 allows the laser beam transmitted through the fθ lens 453 to be focused on the photoreceptor 43.

The mirror 455 allows the laser beam immediately before scanning the surface of the photoreceptor 43 to be reflected and guided to the synchronization sensor 44.

After detecting the laser beam, the synchronization sensor 44 outputs a detection signal to the control unit 10. After receiving the detection signal, the control unit 10 generates a synchronization signal to be a reference of a start timing of scanning by each of the polygon surfaces 42*a*.

Figure 4:
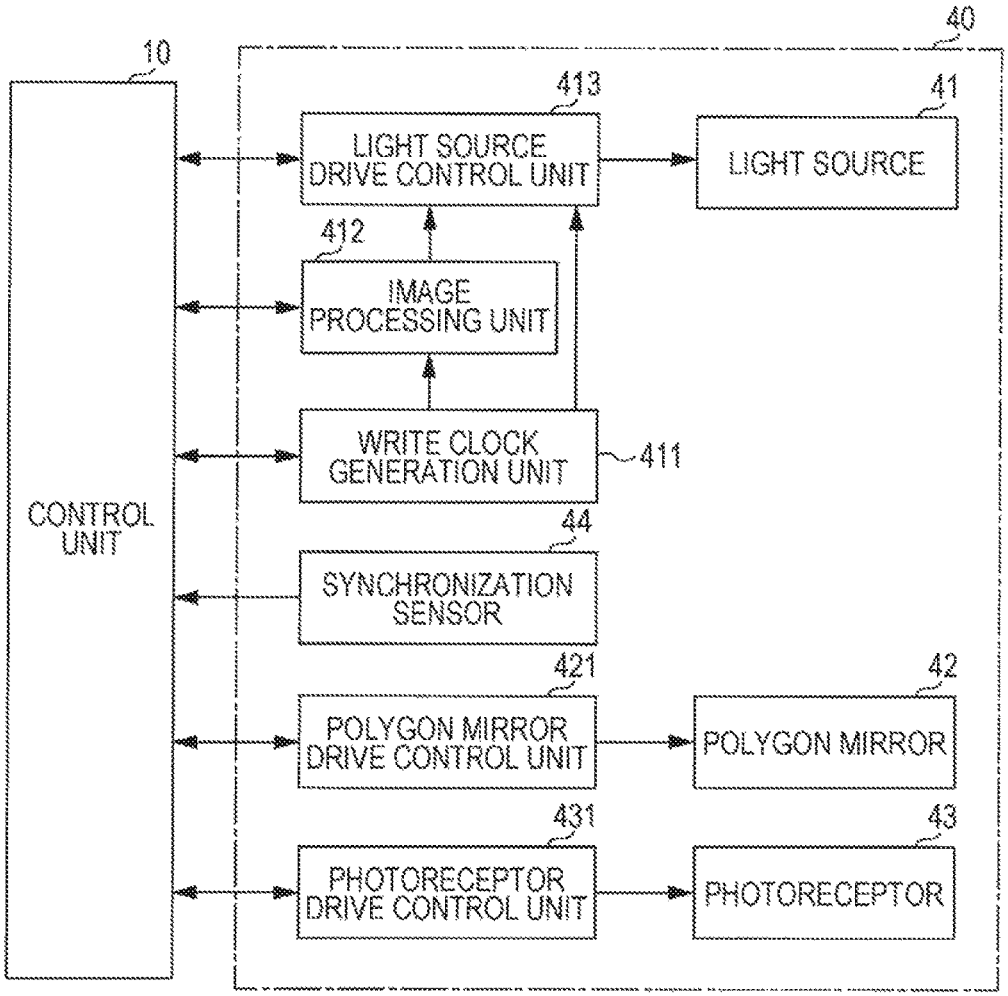
FIG. 4 is a functional block diagram illustrating a main functional configuration of a portion related to the formation of an electrostatic latent image in an image forming unit.

FIG. 4 is a functional block diagram illustrating the main functional configuration of portions related to the formation of an electrostatic latent image in the image forming unit 40.

The image forming unit 40 includes: a write clock generation unit 411 (clock characteristic changer) for controlling the light emission operation performed by the light source 41; an image processing unit 412: a light source drive control unit 413; a polygon mirror drive control unit 421 that controls rotating operation of the polygon mirror 42; and a photoreceptor drive control unit 431 that controls rotating operation of the photoreceptor 43.

The write clock generation unit 411 generates a write pixel clock (hereinafter referred to as a write clock PCLK) used for laser beam scanning, and outputs the generated clock to the image processing unit 412 and the light source drive control unit 413. The write clock generation unit 411 can adjust and output a clock characteristic of the write clock PCLK used for the scanning performed by the polygon surface 42*a* for each of polygon surfaces 42*a* of the polygon mirror 42. Here, the clock characteristic includes at least a part of frequency and phase of the write clock PCLK.

Figure 5:
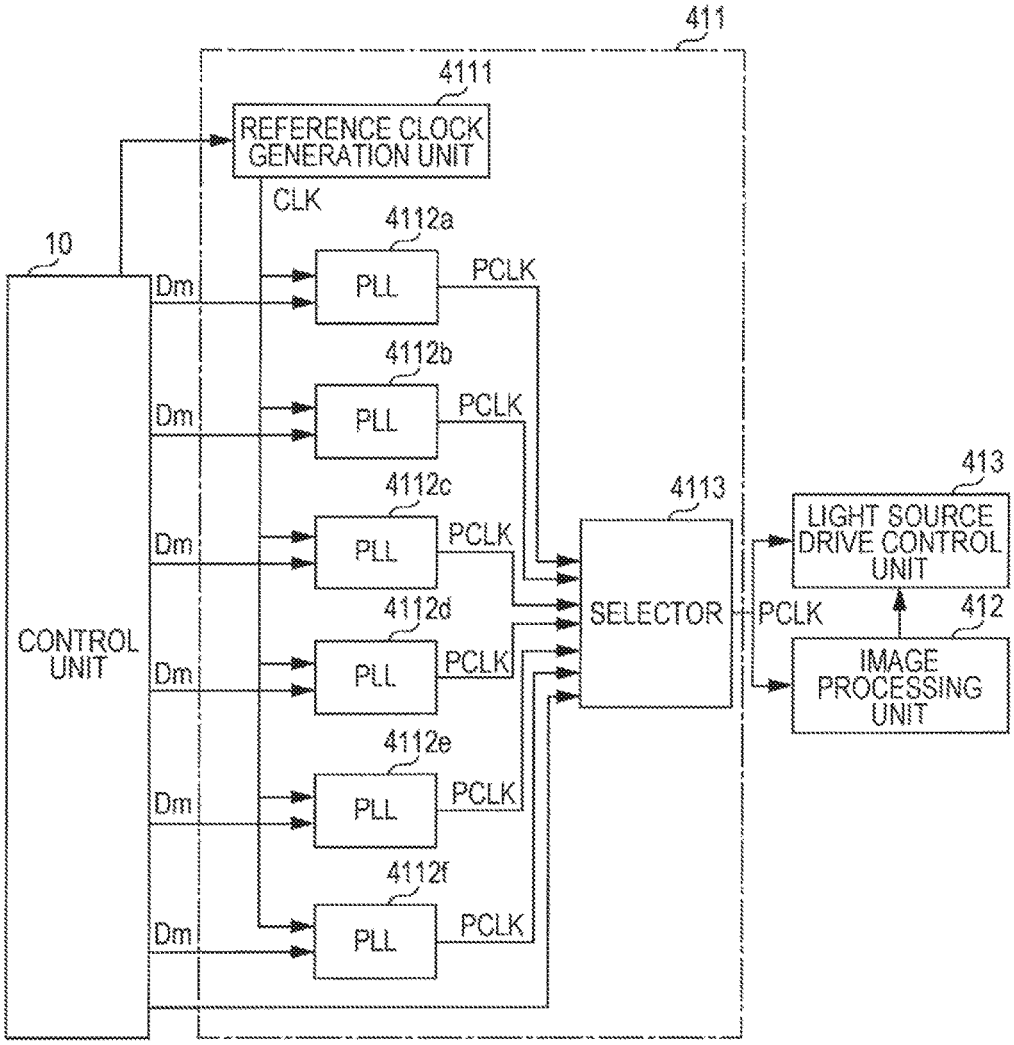
FIG. 5 is a block diagram illustrating a configuration of a write clock generation unit.

FIG. 5 is a block diagram illustrating a configuration of the write clock generation unit 411.

The write clock generation unit 411 includes: a reference clock generation unit 4111, six phase locked loops (PLL) 4112*a* to 4112*f* (hereinafter referred to as a PLL 4112 unless distinction is needed), and a selector 4113.

The six PLLs 4112*a* to 4112*f* correspond to the first polygon surface to the sixth polygon surface of the polygon mirror 42, respectively. Each of the PLL 4112 receives an input of a correction value Dm that has been set in accordance with a state of the corresponding polygon surface 42*a* (surface irregularities and rotation speed) and reference clock CLK generated by the reference clock generation unit 4111. The PLL 4112 adjusts the frequency of the reference clock CLK in accordance with the correction value Dm and outputs the clock as a write clock PCLK via a phase synchronization circuit (not illustrated).

Specifically, the PLL 4112 includes: a 1/M frequency divider that divides the frequency of the reference clock CLK into 1/M and inputs the divided clock to a phase comparator, a 1/N frequency divider that divides the frequency of the write clock PCLK as an output of the PLL 4112 (output of VCO to be described below) into 1/N and inputs the divided clock to the phase comparator, and a voltage controlled oscillator (VCO) that outputs the write clock PCLK with a frequency corresponding to the signal obtained by smoothing the output of the phase comparator with a low-pass filter. The PLL 4112 like this makes is possible to output the write clock PCLK having a frequency obtained by multiplying the frequency of the reference clock CLK by N/M. Here, a frequency division ratio M used in the 1/M frequency divider can be changed in accordance with the correction value Dm input from the control unit 10. This configuration enables the PLL 4112 to output the write clock PCLK with the frequency adjusted in accordance with the correction value Dm.

The selector 4113 selects (switches to) any one of the write clocks PCLK output from the PLLs 4112*a* to 4112*f* in accordance with a control signal (signal for specifying the polygon surface 42*a* used for scanning and the above-described synchronization signal) received from the control unit 10, and outputs the selected clock to the image processing unit 412 and the light source drive control unit 413.

The image processing unit 412 in FIG. 4 is a unit that applies various image processing on the image data stored in the storage 21, and transfers image data necessary for image formation to the light source drive control unit 413 in synchronization with the synchronization signal input from the control unit 10 and the write clock PCLK input from the write clock generation unit 411.

The light source drive control unit 413 controls the light source 41 to emit a laser beam modulated in accordance with image data transferred from the image processing unit 412, in synchronization with the write clock PCLK input from the write clock generation unit 411.

The polygon mirror drive control unit 421 controls to operate the polygon motor of the polygon mirror 42 in accordance with the control signal from the control unit 10, so as to rotate the polygon mirror 42 at a predetermined rotation speed.

The photoreceptor drive control unit 431 controls to operate the rotary motor of the photoreceptor 43 in accordance with the control signal from the control unit 10, so as to rotate the photoreceptor 43 at a predetermined rotation speed.

<Method of Correcting Exposure Position>

It is preferable that each of the polygon surfaces 42*a* of the polygon mirror 42 has no surface irregularities, having the orientation of the normal line in the secondary scanning direction aligned, and having no unevenness in the rotation speed. Execution of the sequential primary scanning with the laser beam using such an ideal polygon surface 42*a*, it is possible to perform desired exposure without position shift in the primary scanning direction and the secondary scanning direction.

Unfortunately, however, the polygon surface 42*a* might often have slight irregularities or "surface tilt" in which the direction of the normal line shifts from a predetermined direction. In addition, the surface shape of the polygon surface 42*a* changes over time due to continuous centrifugal force or the like in some cases. Furthermore, a change in characteristics of the polygon motor of the polygon mirror 42 often causes the rotation speed of the polygon surface 42*a* to change with time or uneven velocity. In this manner, in a case where the polygon surface 42*a* is not in an ideal state and there are variations in the state of the plurality of polygon surfaces 42*a*, an exposure position shift might occur in each of scanning of each of the polygon surfaces 42*a* in accordance with the state of the polygon surface 42*a*.

In contrast, the image forming apparatus 1 of the present embodiment adjusts the write clock PCLK for each of the polygon surfaces 42*a*, making it possible to correct the exposure position shift in the primary scanning direction. Hereinafter, a method of correcting the exposure position will be described.

Figure 6A:
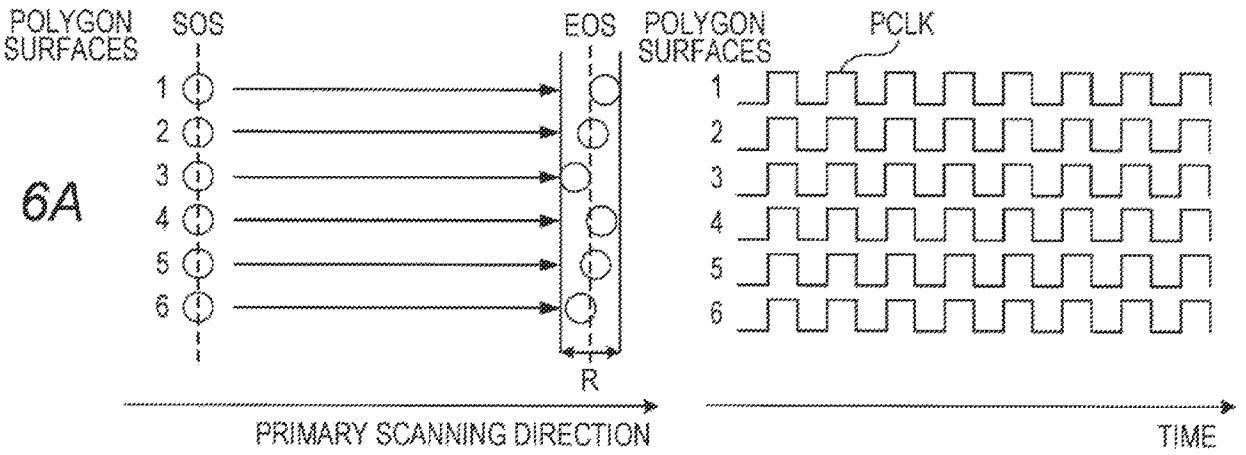
FIGS. 6A and 6B are diagrams illustrating a method of correcting a shift of exposure position
Figure 6B:
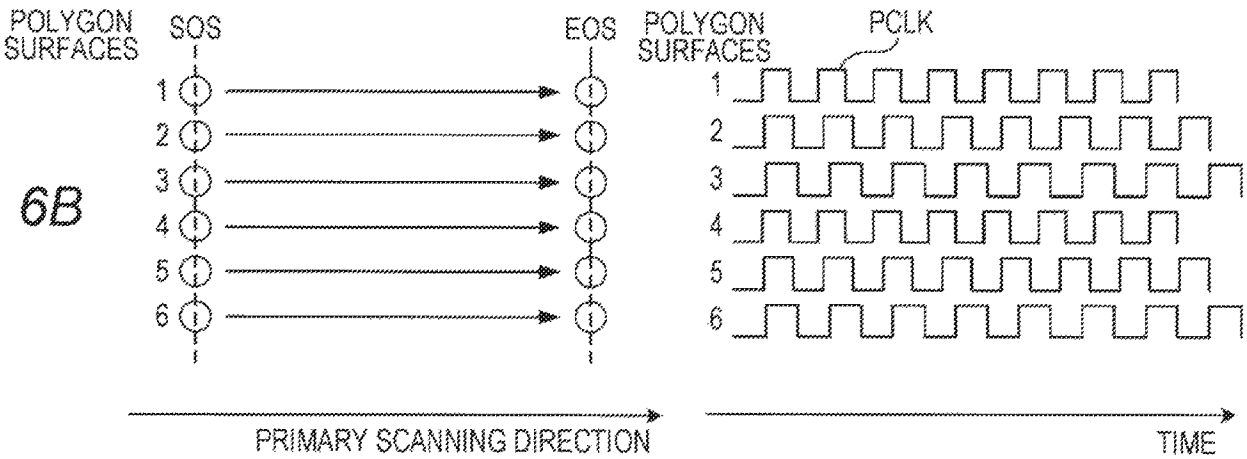

FIGS. 6A and 6B are diagrams illustrating a method of correcting a shift of exposure position.

FIG. 6A is a diagram illustrating a state of scanning in the case where the exposure position shift in the primary scanning direction is not corrected. The left side portion of FIG. 6A illustrates a range of scanning in the primary scanning direction performed using the first polygon surface to the sixth polygon surface. Here. "Start Of Scan (SOS)" indicates a scanning start position in the primary scanning direction while End Of Scan (EOS)" indicates a scanning ending position in the primary scanning direction. In addition, as illustrated in the right side portion of FIG. 6A, this scanning is performed by using the write clock PCLK having the same clock characteristics for each of the polygon surfaces 42*a*.

Exposure is performed at a predetermined timing immediately after generation of the above-described synchronization signal, leading to mutual alignment of the SOS in scanning by each of the polygon surfaces 42*a* with each other in the primary scanning direction. In contrast, the EOS in the scanning by each of the polygon surfaces 42*a* varies over a range R in the primary scanning direction, reflecting a mutual difference in the state of each of the polygon surfaces 42*a*. Such EOS variation in the primary scanning direction is also referred to as jitter. In the present embodiment, the size of the pixels in the image to be formed is from about 10 μm (2400 dpi) to about 20 μm (1200 dpi), and the size of a jitter occurrence range R is several μm, for example.

FIG. 6B is a diagram illustrating a state of scanning in a case where the exposure position shift in the primary scanning direction is corrected.

As illustrated in FIG. 6A, when the exposure position is shifted (varies) in the primary scanning direction for each of the polygon surfaces 42*a*, it is possible to adjust the frequency of the write clock PCLK for each of the polygon surfaces 42*a* in accordance with the amount of exposure position shift so as to correct the exposure position shift as illustrated on the left side portion of FIG. 6B. That is, as illustrated on the right side portion of FIG. 6B, with the frequency of the write clock PCLK decreased for the polygon surface 42*a* in which the EOS is shifted in the negative direction in the primary scanning direction, and with the frequency of the write clock PCLK increased for the polygon surface 42*a* in which the EOS is shifted in the positive direction in the primary scanning direction, it is possible correct exposure position shift and eliminate variation of EOS, as illustrated on the left side portion of FIG. 6B.

<Method of Detecting Exposure Position Shift>

In the present embodiment, even in a case where the exposure position shifted changes with time or there is a non-linear exposure position shift with respect to the position in the primary scanning direction, it is possible to detect and correct the shift.

Hereinafter, a method of detecting the exposure position shift will be described.

Figure 7:
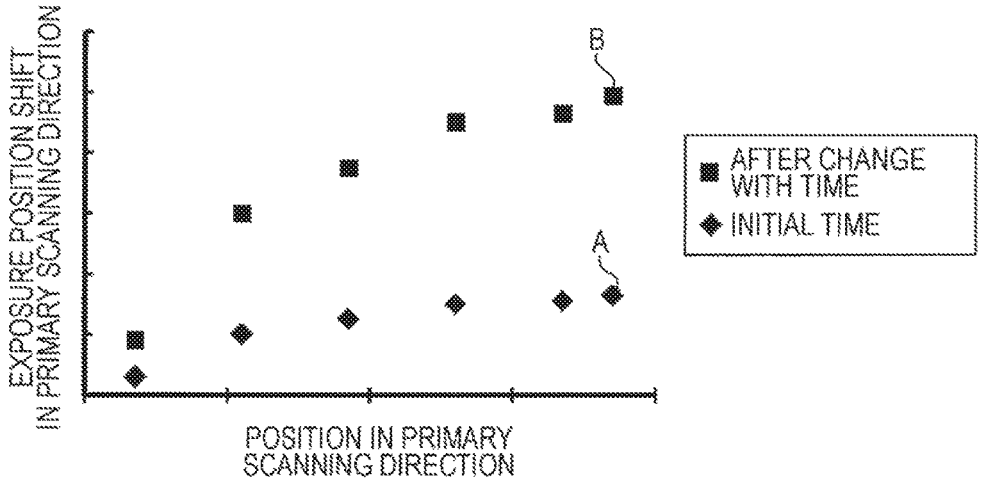
FIG. 7 is a diagram illustrating an example of a change with time in the exposure position shift.

FIG. 7 is a diagram illustrating an example of a change with time in the exposure position shift.

In FIG. 7, plot A plots the amount of exposure position shift in an initial state for each of positions in the primary scanning direction, and plot B plots the amount of exposure position shift after a predetermined time elapsed (after change with time).

In this manner, the exposure position shift changes with time. As described above, this is due to the shape of each of polygon surfaces 42*a* and the change with time in the rotation speed.

Moreover, in each of plot A and plot B, the amount of exposure position shift changes non-linearly with respect to the position in the primary scanning direction. This is due to unevenness in the shape and rotation speed of each of the polygon surfaces 42*a* in the primary scanning direction.

In this manner, in the present embodiment, in order to detect and accurately correct the shift, that is, the exposure position shift having changed with time or a non-linear exposure position shift, the image forming apparatus 1 records a predetermined test chart on a recording medium and analyzes a reading result of the test chart to detect the exposure position shift.

Figure 8:
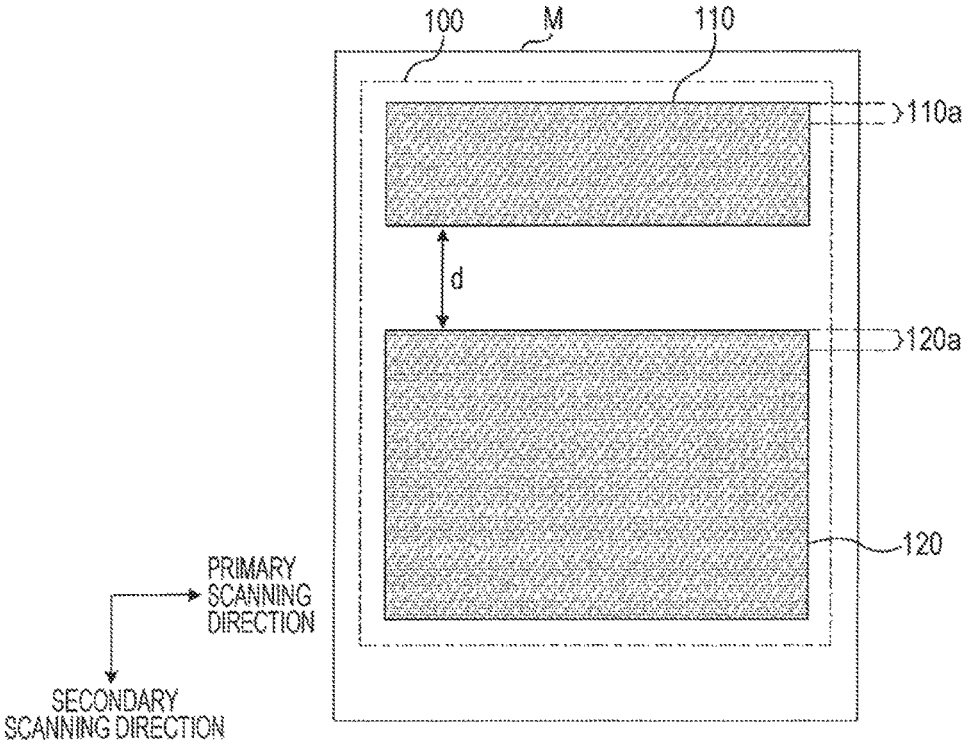
FIG. 8 is a view illustrating an example of a test chart formed on a recording medium.

FIG. 8 is a diagram illustrating an example of a test chart 100 formed on a recording medium M.

The test chart 100 has a polygon surface specifying pattern 110 (mirror surface specifying pattern) and an exposure position shift detection pattern 120 (detection pattern) formed at a predetermined relative position with respect to the polygon surface specifying pattern 110 in the secondary scanning direction. The polygon surface specifying pattern 110 is formed in a rectangular region extending in the primary scanning direction in the vicinity of one end portion of the recording medium M in the secondary scanning direction. In addition, the exposure position shift detection pattern 120 has a same width as the polygon surface specifying pattern 110 in the primary scanning direction and is formed in a rectangular region apart from the polygon surface specifying pattern 110 by a predetermined interval d in the secondary scanning direction.

The recording medium M on which the test chart 100 is formed constitutes a test chart formation medium.

The polygon surface specifying pattern 110 includes a unit specifying pattern 110*a*, formed by scanning, in which one scanning is performed by each of the first polygon surface to the sixth polygon surface. This unit specifying pattern 110*a* is repeatedly formed in the secondary scanning direction. The unit specifying pattern 110*a*, enables specifying a reference portion formed by scanning with a specific one polygon surface 42*a* (the first polygon surface in the present embodiment).

Moreover, the exposure position shift detection pattern 120 includes a unit detection pattern 120*a*, formed by scanning, in which one scanning is performed by each of the first polygon surface to the sixth polygon surface. This unit detection pattern 120*a* is repeatedly formed in the secondary scanning direction.

The width of the unit specifying pattern 110*a* and the unit detection pattern 120*a* in the secondary scanning direction is, for example, about 1 mm.

Figure 9A:
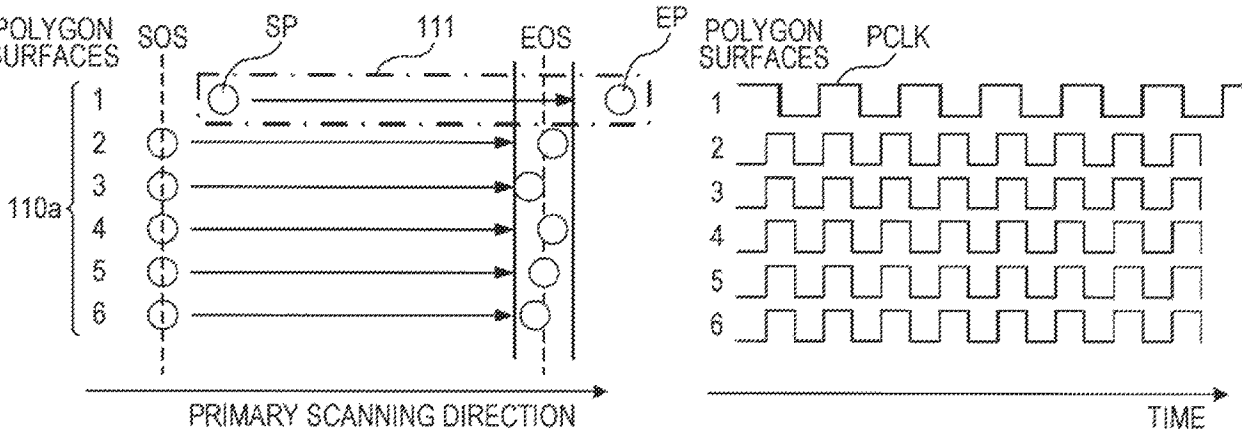
FIGS. 9A and 9B are diagrams for illustrating a unit specifying pattern and a unit detection pattern.
Figure 9B:
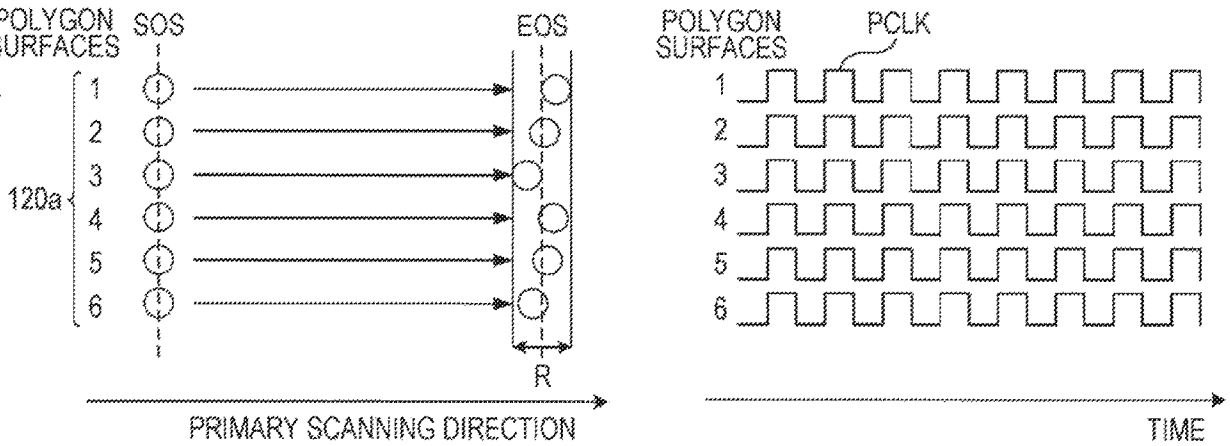

FIGS. 9A and 9B are diagrams illustrating the unit specifying pattern 110*a* and the unit detection pattern 120*a*.

The left side portion of FIG. 9A illustrates the unit specifying pattern 110*a*, while the right side portion of FIG. 9A illustrates the write clock PCLK used for forming the unit specifying pattern 110*a*, illustrated for each of the polygon surfaces 42*a*.

As illustrated on the right side portion of FIG. 9A, in formation of the unit specifying pattern 110*a*, the frequency of the write clock PCLK used for scanning using the first polygon surface is extremely smaller than the frequency of the write clock PCLK used for scanning using the second polygon surface to the sixth polygon surface, with the phase shifted.

As a result of execution of scanning using each of the polygon surfaces 42*a* with such a write clock PCLK, the unit specifying pattern 110*a* is configured to have the reference portion 111 formed by scanning with the first polygon surface, being formed with a large shift in the positive direction of the primary scanning direction than the portions formed with the scanning with the second polygon surface to the sixth polygon surface, as illustrated on the left side portion of FIG. 9A. With this configuration, the reference portion 11 formed by the scanning by the first polygon surface can be easily specified in the unit specifying pattern 110*a*.

Alternatively, it is also allowable to just adjust the frequency in the adjustment of the write clock PCLK corresponding to the first polygon surface so as to shift the position of EOS, without shifting the position of the SOS. Furthermore, it is also allowable to just adjust the phase to shift the whole of the unit specifying pattern 110*a* in the secondary scanning direction.

The unit specifying pattern 110*a* is not particularly limited in formation, and may be formed as a solid pattern, for example.

The left side portion of FIG. 9B illustrates the unit detection pattern 120*a*, while the right side portion of FIG. 9B illustrates the write clock PCLK used for forming the unit detection pattern 120*a*, illustrated for each of the polygon surfaces 42*a*.

As illustrated on the right side portion of FIG. 9B, the write clock PCLK having the same clock characteristic is used for scanning using each of the polygon surfaces 42*a* in the formation of the unit detection pattern 120*a*. As a result, as illustrated in the left side portion of FIG. 9B, an exposure position shift in the primary scanning direction (jitter in an EOS range R) reflecting the state (shape and rotation speed) of each of the polygon surfaces 42*a* appears as it is in the unit detection pattern 120*a*.

Figure 10:
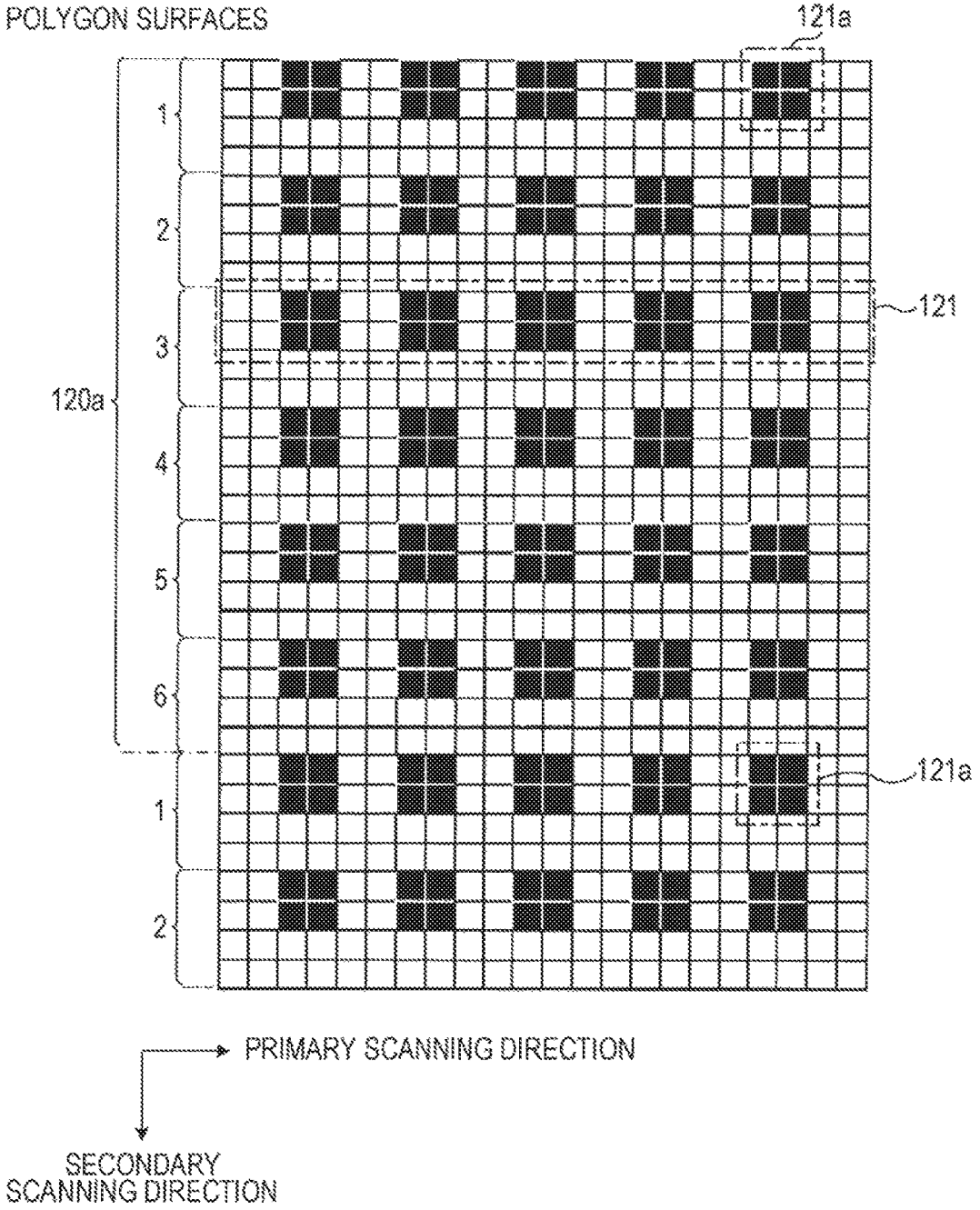
FIG. 10 is a diagram illustrating an example of details of a unit detection pattern.

FIG. 10 is a diagram illustrating an example of details of the unit detection pattern 120*a*.

In the unit detection pattern 120*a*, on-pixels (toner application pixels) are formed on the upper two pixel rows alone among the four pixel rows in the secondary scanning direction, respectively formed by four laser beams in the scanning with each of the polygon surfaces 42*a*, so as to form an individual pattern 121, while the lower two pixel rows are formed as an off-pixel (blank pixels with no toner application). In this manner, the unit detection pattern 120*a* (exposure position shift detection pattern 120) includes the individual pattern 121 formed by the scanning by each of the plurality of polygon surfaces 42*a*, being formed in a state separated from each other in the secondary scanning direction.

In addition, exposure is performed such that on-pixels and off-pixels are alternately arranged every two pixels in the primary scanning direction as well. Therefore, the unit detection pattern 120*a* is formed in a "two on/two off" pattern in which both the on-pixel and the off-pixel appear alternately every two pixels both in the primary scanning direction and the secondary scanning direction leading to a pattern in which the individual unit patterns 121*a* having the size of 2×2 pixels are arranged in a matrix pattern both in the primary scanting direction and the secondary scanning direction.

Note that the unit specifying pattern 110*a* may also be formed in a pattern as illustrated in FIG. 10.

With the polygon surface specifying pattern 110 of FIG. 8, it is possible to specify the position of the reference portion 111 included in each unit specifying pattern 110*a* in the secondary scanting direction. Therefore, it is possible to specify the polygon surface 42*a* used for forming each portion of the exposure position shift detection pattern 120 on the basis of the position of the reference portion 11 and the size (number of pixels) of an interval d in the secondary scanning direction. That is, as illustrated in FIG. 10, it is possible to specify the number of the polygon surface 42*a* corresponding to each of the individual patterns 121.

With association of the specifying result of the polygon surface 42*a* and the shift amount of the position of the individual unit pattern 121*a* in the exposure position shift detection pattern 120 from the predetermined position, it is possible to detect the exposure position shift corresponding to each of the polygon surfaces 42*a*.

Specifically, first, the plurality of individual patterns 121 formed by the first polygon surface is focused in the exposure position shift detection pattern 120. The individual patterns 121 corresponding to the first polygon surface appear every six positions in the secondary scanning direction in the exposure position shift detection pattern 120. With operation of specifying and averaging the positions in the primary scanning direction of the individual unit pattern 121*a* corresponding to the positions in the primary scanning direction in each of the plurality of individual patterns 121 corresponding to the first polygon surface, it is possible to detect the exposure position shift at the position in the primary scanning direction on the first polygon surface. With execution of detection for each of positions in the primary scanning direction, it is possible to detect the exposure position shift at each of positions in the primary scanning direction on the first polygon surface. As described above, since the amount of exposure position shift is as small as several μm, it is usually difficult to directly detect the shift from a result of reading performed by the image reading unit 50. Still, with a calculation method of averaging the positions of the plurality of individual unit patterns 121*a*, it is possible to detect the exposure position shift with high accuracy.

Similarly, it is also possible to detect the exposure position shift at each of positions of the polygon surface 42*a* in the primary scanning direction, for each of the second polygon surface to the sixth polygon surface.

With operation of adjusting the frequency of the write clock PCLK used for scanning with each of the polygon surfaces 42*a* as illustrated in FIG. 6B on the basis of the exposure position shift for each of the polygon surfaces 42*a*, it is possible to correct the exposure position shift in the primary scanning direction corresponding to the state of each of the polygon surfaces 42*a*.

Note that while the example of FIG. 6B fixes the frequency of the write clock PCLK for each of the polygon surfaces 42*a*, the write clock PCLK may be changed during scanning depending on the shift amount of the exposure position at each of positions in the primary scanning direction.

Next, a procedure to control exposure position correction processing executed in the image forming apparatus 1, executed by the control unit 10, will be described.

Figure 11:
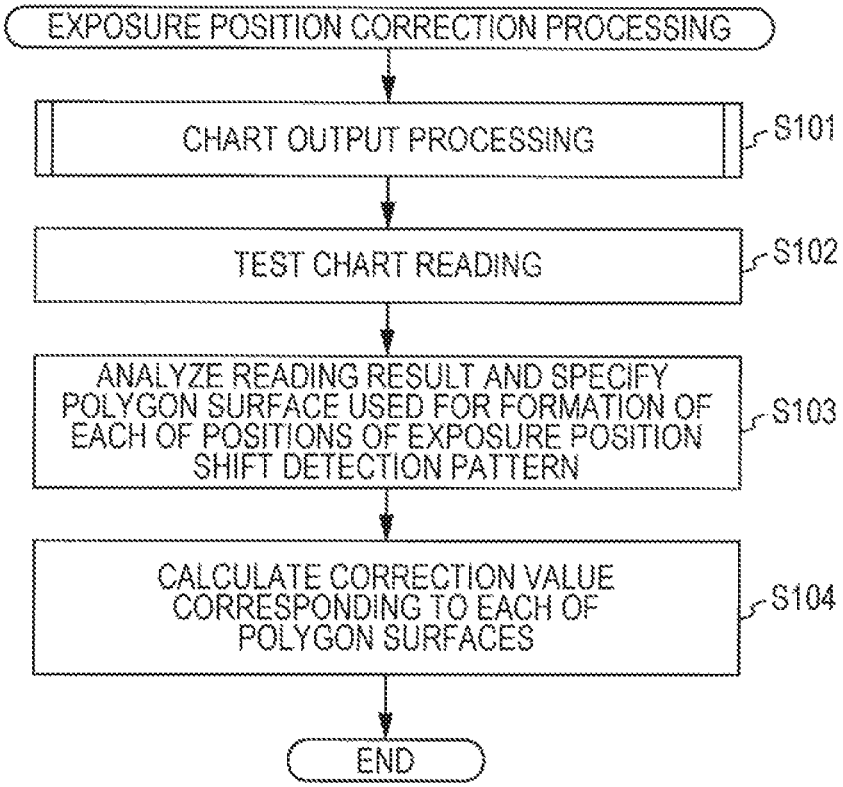
FIG. 11 is a flowchart illustrating a procedure to control exposure position correction processing.

FIG. 11 is a flowchart illustrating a procedure to control exposure position correction processing.

When the exposure position correction processing is started, the control unit 10 executes chart output processing of forming the test chart 100 on the recording medium M (step S101). Details of the chart output processing will be described below.

After completion of the chart output processing, the control unit 10 causes the image reading unit 50 to read the test chart 100 on the recording medium M (step S102).

Next, the control unit 10 analyzes the reading result (image data of the test chart 100), and specifies the polygon surface 42*a* used for forming each of positions of the exposure position shift detection pattern 120 (step S103). That is, the control unit 10 specifies the polygon surface 42*a* corresponding to each of the individual patterns 121 of the exposure position shift detection pattern 120 on the basis of the position of the reference portion 111 in the secondary scanning direction on the polygon surface specifying pattern 110 of the test chart 100 and on the basis of the number of pixels in the interval d between the polygon surface specifying pattern 110 and the exposure position shift detection pattern 120.

Next, the control unit 10 detects the exposure position shift for each of the polygon surfaces 42*a* in accordance with the above-described algorithm, and calculates the correction value Dm corresponding to each of the polygon surfaces 42*a* on the basis of the detection result (step S104).

Steps S103 and S104 correspond to a correction step.

After completion of the processing of step S104, the control unit 10 finishes the exposure position correction processing. Thereafter, when image formation is performed by the image forming apparatus 1, the control unit 10 corrects the write clock PCLK used for scanning with each of the polygon surfaces 42*a* on the basis of the correction value Din calculated in step S04.

Figure 12:
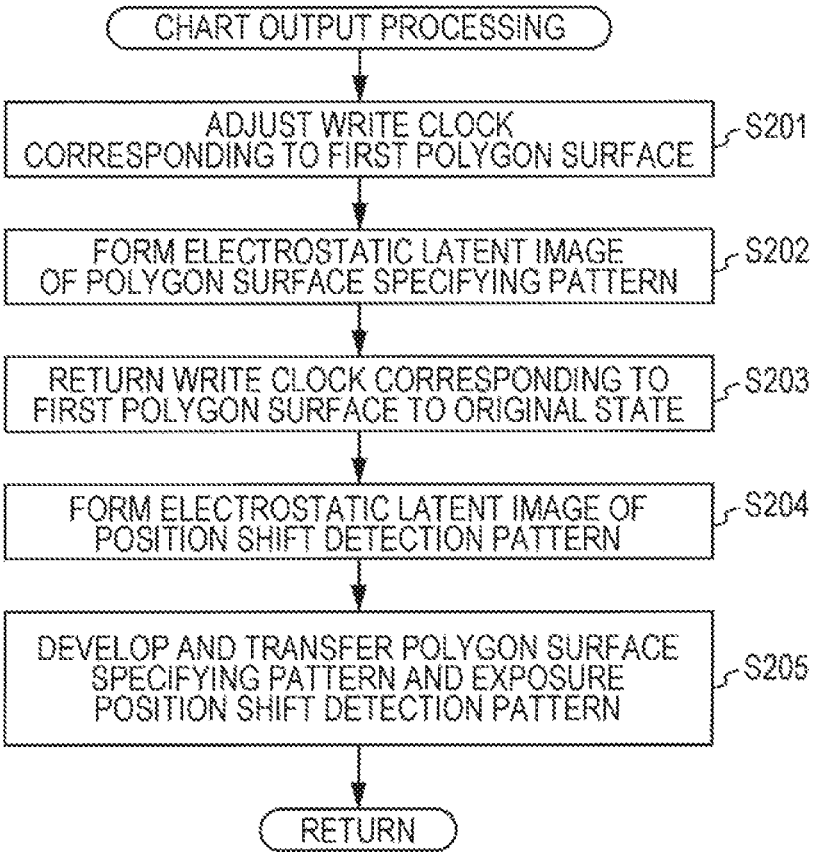
FIG. 12 is a flowchart illustrating a procedure to control chart output processing.

FIG. 12 is a flowchart illustrating a procedure to control the chart output processing.

When the chart output processing is provoked, the control unit 10 adjusts the write clock PCLK corresponding to the first polygon surface (step S201). That is, as illustrated on the right side portion of FIG. 9B, the control unit 10 performs operation setting of the write clock generation unit 411 so as to set the clock characteristic of the write clock PCLK corresponding to the first polygon surface to be different from the clock characteristic of the write clock PCLK corresponding to the second polygon surface to the sixth polygon surface.

Next, the control unit 10 forms an electrostatic latent image of the polygon surface specifying pattern 110 on the photoreceptor 43 (step S202). That is, the control unit 10 causes the photoreceptor drive control unit 431 to rotate the charged photoreceptor 43 to move the surface of the photoreceptor 43 in the secondary scanning direction while causing the polygon mirror drive control unit 421 to rotate the polygon mirror 42 to perform sequential primary scanning with light beams modulated in accordance with the image data of the polygon surface specifying pattern 110 so as to control to execute two-dimensional exposure of the surface of the photoreceptor 43 to form the electrostatic latent image of the polygon surface specifying pattern 110.

After completion of formation of the electrostatic latent image of the polygon surface specifying pattern 110, the control unit 10 returns the write clock PCLK corresponding to the first polygon surface to its original state (step S203). Here, the control unit 10 changes the operation setting of the write clock generation unit 411 so as to set the clock characteristic of the write clock PCLK corresponding to the first polygon surface to be equal to the clock characteristic of the write clock PCLK corresponding to the second polygon surface to the sixth polygon surface.

Next, the control unit 10 forms an electrostatic latent image of the exposure position shift detection pattern 120 on the photoreceptor 43 (step S204). That is, the control unit 10 rotates the polygon mirror 42 while rotating the photoreceptor 43, and controls to perform sequential primary scanning with the light beams modulated in accordance with the image data of the exposure position shift detection pattern 120 so as to execute the two-dimensional exposure of the surface of the photoreceptor 43 to form the electrostatic latent image of the exposure position shift detection pattern 120.

Steps S201 to S204 correspond to a light source control step and an exposure control step.

Next, the control unit 10 controls each portion of the image forming unit 40 to develop the polygon surface specifying pattern 110 and the exposure position shift detection pattern 120, and controls to allow these patterns to be transferred and fixed to the recording medium M (step S205).

Step S205 corresponds to an image forming step.

After completion of the processing of step S205, the control unit 10 returns the processing to the exposure position correction processing.

(Modification)

Subsequently, a modification of the above embodiment will be described.

While the above embodiment is an example of correcting the exposure position shift in the primary scanning direction, the present modification is a case of detecting and correcting the exposure position shift in the secondary scanning direction in place of or in addition to the shift correction in the primary scanning direction. Differences from the above embodiment will be described below.

In the case where the normal to the polygon surface 42*a* of the polygon mirror 42 is inclined in the secondary scanning direction from a desired direction, that is, in a case where the surface tilt in the secondary scanning direction is generated in the polygon surface 42*a*, the exposure position of scanning with the polygon surface 42*a* would be shifted in the secondary scanning direction. In this case, since the individual pattern 121 and the individual unit pattern 121*a* in FIG. 10 would be shifted in the secondary scanning direction, and thus, detecting of this shift makes it possible to detect the exposure position shift in the secondary scanning direction for each of the polygon surfaces 42*a*.

In order to correct the shift in the secondary scanning direction thus detected, for example, it would be satisfactory to perform correction of shifting the pixel data in the image data used for image formation in the secondary scanning direction in accordance with the amount of exposure position shift in the secondary scanning direction for each of the detected polygon surfaces 42*a*.

Alternatively, it is allowable to use a configuration that uses a light source capable of emitting a large amount of laser beams in parallel in the secondary scanning direction and that selects a laser beam to be used for exposure for each of the polygon surfaces 42*a*, and in this configuration, it is allowable to change the laser beam selected on the basis of the detected exposure position shift in the secondary scanning direction for each of the polygon surfaces 42*a* so as to correct the exposure position shift.

In a case where also the shift in the primary scanning direction is to be corrected in addition to the shift in the secondary scanning direction, it would be satisfactory to perform adjustment of the write clock PCLK together.

As described above, the image forming apparatus 1 according to the present embodiment includes the photoreceptor 43; the light source 41; the polygon mirror 42 (rotational polygon mirror); and the control unit 10. The polygon mirror 42 includes the plurality of polygon surfaces 42*a* (mirror surfaces) on the outer circumferential surface of a rotating body that rotates around a predetermined rotation axis, and is provided to achieve a configuration to execute sequential primary scanning in which laser beam is emitted from the light source 41 to the rotating outer circumferential surface, and laser beam reflected on each of the plurality of polygon surfaces 42*a* sequentially scans over the surface of the photoreceptor 43 in the primary scanning direction. The control unit 10 controls the light source 41 to perform emission of a laser beam modulated on the basis of the image data to be performed in accordance with the write clock (light source control unit), and controls to rotate the polygon mirror 42 to perform sequential primary scanning with the modulated laser beam while moving the surface of the charged photoreceptor 43 in the secondary scanning direction so as to control to execute two-dimensional exposure of the surface of the photoreceptor 43 to form an electrostatic latent image of an image related to image data (exposure control unit). The image forming apparatus 1 includes the write clock generation unit 411 capable of changing a clock characteristic including at least one of frequency and phase of the write clock. The control unit 10 corrects a shift (correction unit) in the laser beam exposure position arising in accordance with a state of each of the plurality of polygon surfaces 42*a*, controls to execute the two-dimensional exposure with the clock characteristic of the write clock used for the scanning with one polygon surface 42*a* among the plurality of polygon surfaces 42*a* differentiated from the clock characteristic of the write clock used for the scanning with the other polygon surfaces 42*a* so as to form an electrostatic latent image of the polygon surface specifying pattern 110 capable of specifying the reference portion 111 formed in the scanning with the one polygon surface 42*a* (exposure control unit), controls to execute the two-dimensional exposure at a predetermined relative position with respect to the polygon surface specifying pattern 110 with a predetermined clock characteristic so as to form an electrostatic latent image of the exposure position shift detection pattern 120 for detecting a shift (exposure control unit), and specifies the polygon surface 42*a* used for formation of each portion of the exposure position shift detection pattern 120 from a positional relationship between the reference portion 111 and the exposure position shift detection pattern 120 on the basis of the reading result of the recording medium M on which the test chart 100 is formed, the test chart 100 being obtained by developing the electrostatic latent image of the polygon surface specifying pattern 110 and the exposure position shift detection pattern 120, and detects and corrects the shift related to each of the plurality of polygon surfaces 42*a* on the basis of the specifying result of the polygon surface 42*a* and the exposure position shift detection pattern 120 (correction unit).

According to this configuration, it is possible to easily specify the polygon surface 42*a* used for forming (scanning) each portion of the test chart 100 on the recording medium M. Therefore, with the exposure position shift specified from the test chart 100, it is possible to easily specify the shift of the exposure position corresponding to the state of the polygon surface 42*a* for each of the polygon surfaces 42*a*, enabling accurate correction of the exposure position shift for each of the polygon surfaces 42*a*.

Moreover, since the exposure position shift of each of the polygon surfaces 42*a* can be detected from the test chart 100 formed by practically performing exposure, it is possible to detect and correct a subsequent exposure position shift. Thus, even when the shape or the rotation speed of the polygon surface 42*a* has changed over time, it is possible to correct the exposure position shift with high accuracy.

Furthermore, since the exposure position shift at each of positions in the primary scanning direction can be detected from the test chart 100, even when there is a non-linear shift in the primary scanning direction, the shift can be accurately detected and corrected.

In addition, compared to the method of using a sensor or the like for detecting the exposure position shift provided on the optical path from the light source 41 to the photoreceptor 43, it is possible to detect and correct the exposure position shift with a simpler structure and at a lower cost, without interfering with the optical path of the laser beam.

Furthermore, the control unit 10 detects and corrects the shift in the primary scanning direction (correction unit). With this configuration, it is possible to suppress occurrence of jitter caused by the exposure position shift in the primary scanning direction for each of the polygon surfaces 42*a*, and possible to suppress occurrence of deterioration in image quality such as streaks due to the interference of the jitter period with the screen processing pattern or the like.

Furthermore, the control unit 10 causes the write clock generation unit 411 to adjust the clock characteristic in accordance with the detected amount of shift so as to correct the shift (correction unit). This makes it possible to accurately correct the exposure position shift in the primary scanning direction by a simple method.

Furthermore, the control unit 10 according to the above modification detects and corrects a shift in the secondary scanning direction (correction unit). With this configuration, even when there is an exposure position shift in the secondary scanning direction due to surface tilt of the polygon surface 42*a*, or the like, the shift can be detected and corrected.

Moreover, the exposure position shift detection pattern 120 includes the individual pattern 121 formed by the scanning on each of the plurality of polygon surfaces 42*a*, the individual patterns 121 being separated from each other in the secondary scanning direction. This makes it possible to accurately detect the exposure position shift for each of the polygon surfaces 42*a* independently of each other.

The image forming apparatus 1 further includes the image reading unit 50 that reads the surface of the recording medium M and the control unit 10 corrects the shift on the basis of a reading result of the recording medium M on which the test chart 100 is formed, obtained by the image reading unit 50 (correction unit). This enables the image forming apparatus 1 to read the test chart 100 and detect and correct the exposure position shift.

A method of correcting an exposure position according to the above embodiment includes: a light source control step of controlling the light source 41 to perform emission of a laser beam modulated on the basis of image data to be performed in accordance with the write clock: an exposure control step of controlling to rotate the polygon mirror 42 to perform sequential primary scanning with the modulated laser beam while moving the surface of the charged photoreceptor 43 in the secondary scanning direction so as to control to execute two-dimensional exposure of the surface of the photoreceptor 43 to form an electrostatic latent image of an image related to image data: and a correction step of correcting a shift in the laser beam exposure position arising in accordance with a state of each of the plurality of polygon surfaces 42*a*, in which the exposure control step controls to execute the two-dimensional exposure with the clock characteristic of the write clock used for the scanning with one polygon surface 42*a* among the plurality of polygon surfaces 42*a* differentiated from the clock characteristic of the write clock used for the scanning with the other polygon surfaces 42*a* so as to form an electrostatic latent image of the polygon surface specifying pattern 110 capable of specifying the reference portion 11 formed in the scanning with the one polygon surface 42*a*, and controls to execute the two-dimensional exposure on a predetermined relative position with respect to the polygon surface specifying pattern 110 with a predetermined clock characteristic so as to form an electrostatic latent image of the exposure position shift detection pattern 120 for detecting a shift, and the correction step specifies the polygon surface 42*a* used for formation of each portion of the exposure position shift detection pattern 120 from a positional relationship between the reference portion 11 and the exposure position shift detection pattern 120 on the basis of the reading result of the recording medium M on which the test chart 100 is formed, the test chart 100 being obtained by developing the electrostatic latent image of the polygon surface specifying pattern 110 and the exposure position shift detection pattern 120, and detects and corrects the shift related to each of the plurality of polygon surfaces 42*a* on the basis of the specifying result of the polygon surface 42*a* and the exposure position shift detection pattern 120.

With a method like this, it is possible to detect and accurately correct the subsequent shift in the exposure position occurring at a certain position in the image forming region.

Moreover, a program according to the above embodiment causes a computer (control unit 10) of the image forming apparatus 1 to function as: a light source control unit that controls the light source 41 to perform emission of a laser beam modulated on the basis of image data to be performed in accordance with the write clock; an exposure control unit that controls to rotate the polygon mirror 42 to perform sequential primary scanning with the modulated laser beam while moving the surface of the charged photoreceptor 43 in the secondary scanning direction so as to control to execute two-dimensional exposure of the surface of the photoreceptor 43 to form an electrostatic latent image of an image related to image data; and a correction unit that corrects a shift in the laser beam exposure position arising in accordance with a state of each of the plurality of polygon surfaces 42*a*. The exposure control unit controls to execute the two-dimensional exposure with the clock characteristic of the write clock used for the scanning with one polygon surface 42*a* among the plurality of polygon surfaces 42*a* differentiated from the clock characteristic of the write clock used for the scanning with the other polygon surfaces 42*a* so as to form an electrostatic latent image of the polygon surface specifying pattern 110 capable of specifying the reference portion 111 formed in the scanning with the one polygon surface 42*a*, and controls to execute the two-dimensional exposure on a predetermined relative position with respect to the polygon surface specifying pattern 110 with a predetermined clock characteristic so as to form an electrostatic latent image of the exposure position shift detection pattern 120 for detecting a shift. The correction unit specifies the polygon surface 42*a* used for formation of each portion of the exposure position shift detection pattern 120 from a positional relationship between the reference portion 111 and the exposure position shift detection pattern 120 on the basis of the reading result of the recording medium M on which the test chart 100 is formed, the test chart 100 being obtained by developing the electrostatic latent image of the polygon surface specifying pattern 110 and the exposure position shift detection pattern 120, and detects and corrects the shift related to each of the plurality of polygon surfaces 42*a* on the basis of the specifying result of the polygon surface 42*a* and the exposure position shift detection pattern 120.

According to such a program, it is possible to detect and accurately correct the subsequent shift in the exposure position occurring at a certain position in the image forming region.

A method of manufacturing a test chart formation medium according to the above embodiment includes: a light source control step of controlling the light source 41 to perform emission of a laser beam modulated on the basis of image data to be performed in accordance with the write clock; and an exposure control step of controlling to rotate the polygon mirror 42 to perform sequential primary scanning with the modulated laser beam while moving the surface of the charged photoreceptor 43 in the secondary scanning direction so as to control to execute two-dimensional exposure of the surface of the photoreceptor 43 to form an electrostatic latent image of an image related to image data, in which the exposure control step controls to execute the two-dimensional exposure with the clock characteristic of the write clock used for the scanning with one polygon surface 42*a* among the plurality of polygon surfaces 42*a* differentiated from the clock characteristic of the write clock used for the scanning with the other polygon surfaces 42*a* so as to font an electrostatic latent image of the polygon surface specifying pattern 110 capable of specifying the reference portion 111 formed in the scanning with the one polygon surface 42*a*, and controls to execute the two-dimensional exposure on a predetermined relative position with respect to the polygon surface specifying pattern 110 with a predetermined clock characteristic so as to form an electrostatic latent image of the exposure position shift detection pattern 120 for detecting a shift, and the manufacturing method includes an image forming step of transferring an image obtained by developing the electrostatic latent image of the polygon surface specifying pattern 110 and the exposure position shift detection pattern 120 onto the recording medium M so as to form the test chart 100 including the polygon surface specifying pattern 110 and the exposure position shift detection pattern 120.

According to such a method, it is possible to manufacture the recording medium M on which the test chart 100 for detecting and accurately correcting the exposure position shift subsequently arising at an arbitrary position in the image forming region, is formed.

The present invention is not limited to the above-described embodiments and modification and may be modified in a variety of ways.

For example, the unit detection pattern 120*a* is not limited to that illustrated in FIG. 10, and may be a pattern in which on-pixels are connected in the primary scanning direction for example.

Furthermore, reading of the test chart 100 may be performed by the scanner 30 or an image reading apparatus provided outside the image forming apparatus 1, instead of performed by the image reading unit 50.

Moreover, it is allowable to perform at least a part of: processing of specifying the polygon surface 42*a* used in formation of each portion of the test chart 100 from the reading result of the test chart 100: processing of detecting the exposure position shift corresponding to each of the polygon surfaces 42*a*, and processing of calculating the correction value, using an information processing apparatus provided outside the image forming apparatus 1.

In addition, the write clock PCLK used for forming the exposure position shift detection pattern 120 does not necessarily have to be the same for each of the polygon surfaces 42*a* as illustrated in FIG. 9B, and it is allowable to use the write clock PCLK having a clock characteristic prescribed for each of the polygon surfaces 42*a*. Even in this case, with reference to the clock characteristic of the write clock PCLK used for scanning, it is possible to detect the exposure position shift from the positions of the individual pattern 121 and the individual unit pattern 121*a* in the exposure position shift detection pattern 120.

In addition, a portion on the test chart 100 between the polygon surface specifying pattern 110 and the exposure position shift detection pattern 120 need not be a blank space and there may be an arbitrary image formed at this portion. For example, when a person specifies the distance d between the polygon surface specifying pattern 110 and the exposure position shift detection pattern 120, it is allowable to form an image in which the number of pixels at the interval d is easy to specify, for example, a stepwise image in units of one pixel.

Furthermore, the light source 41 is not limited to the multi-beam type, and may be configured to scan on each of the polygon surfaces 42*a* with emission of a single laser beam.

Although embodiments of the present invention have been described and illustrated in detail, the disclosed embodiments are made for purposes of illustration and example only and not limitation. The scope of the present invention includes the scope of the invention described in the appended claims and the scope of their equivalents of the appended claims, and should be interpreted by terms of the appended claims.

What is claimed is:

1. An image forming apparatus comprising:

a photoreceptor;

a light source;

a rotational polygon mirror including a plurality of mirror surfaces on an outer circumferential surface of a rotating body that rotates around a predetermined rotation axis and being provided to achieve a configuration to execute sequential primary scanning in which a light beam is emitted from the light source to the rotating outer circumferential surface, and the light beam reflected on each of the plurality of mirror surfaces sequentially scans over a surface of the photoreceptor in a predetermined primary scanning direction; and a hardware processor that:

controls the light source to perform emission of the light beam modulated on the basis of image data in accordance with a write clock;

controls to rotate the rotational polygon mirror to perform the sequential primary scanning with the modulated light beam while moving the surface of the charged photoreceptor in a secondary scanning direction intersecting the primary scanning direction so as to control to execute two-dimensional exposure of the surface of the photoreceptor to form an electrostatic latent image of an image related to the image data; and corrects a shift of an exposure position of the light beam arising in accordance with a state of each of the plurality of mirror surfaces; and a clock characteristic changer capable of changing a clock characteristic including at least one of frequency and phase of the write clock, wherein the hardware processor controls to execute the two-dimensional exposure with the clock characteristic of the write clock used for the scanning on one mirror surface among the plurality of mirror surfaces differentiated from the clock characteristic of the write clock used for the scanning with another mirror surfaces so as to form an electrostatic latent image of a mirror surface specifying pattern capable of specifying a reference portion formed in the scanning over the one mirror surface, controls to execute the two-dimensional exposure at a predetermined relative position with respect to the mirror surface specifying pattern with a predetermined clock characteristic so as to form an electrostatic latent image of a detection pattern for detecting the shift, and specifies a mirror surface used for formation of each portion of the detection pattern from a positional relationship between the reference portion and the detection pattern on the basis of a reading result of a recording medium on which a test chart is formed, the test chart being obtained by developing the electrostatic latent image of the mirror surface specifying pattern and the detection pattern, and detects and corrects the shift related to each of the plurality of mirror surfaces on the basis of a specifying result of the mirror surface and the detection pattern.

2. The image forming apparatus according to claim 1, wherein the hardware processor detects and corrects the shift in the primary scanning direction.

3. The image forming apparatus according to claim 2, wherein the hardware processor corrects the shift by adjusting the clock characteristic using the clock characteristic changer in accordance with the detected amount of the shift.

4. The image forming apparatus according to claim 1, wherein the hardware processor detects and corrects the shift in the secondary scanning direction.

5. The image forming apparatus according to claim 1, wherein the detection pattern includes individual patterns formed by the scanning on each of the plurality of mirror surfaces, and the individual patterns are separated from each other in the secondary scanning direction.

6. The image forming apparatus according to claim 1, further comprising a reader that reads a surface of a recording medium, wherein the hardware processor corrects the shift on the basis of a reading result of the reader of the recording medium on which the test chart is formed.

7. A method for correcting an exposure position on an image forming apparatus including:

a photoreceptor; a light source; a rotational polygon mirror including a plurality of mirror surfaces on an outer circumferential surface of a rotating body that rotates around a predetermined rotation axis and being provided to achieve a configuration to execute sequential primary scanning in winch a light beam is emitted from the light source to the rotating outer circumferential surface, and the light beam reflected on each of the plurality of mirror surfaces sequentially scans over a surface of the photoreceptor in a predetermined primary scanning direction; and a clock characteristic changer capable of changing a clock characteristic including at least one of frequency and phase of a write clock used for the scanning;

the method comprising:

controlling the light source to perform emission of the light beam modulated on the basis of image data to be performed in accordance with the write clock;

controlling exposure to rotate the rotational polygon mirror to perform the sequential primary scanning with the modulated light beam while moving the surface of the charged photoreceptor in a secondary scanning direction intersecting the primary scanning direction so as to control to execute two-dimensional exposure of the surface of the photoreceptor to form an electrostatic latent image of an image related to the image data;

and correcting a shift of an exposure position of the light beam arising in accordance with a state of each of the plurality of mirror surfaces, wherein the controlling of exposure controls to execute the two-dimensional exposure with the clock characteristic of the write clock used for the scanning on one mirror surface among the plurality of mirror surfaces differentiated from the clock characteristic of the write clock used for the scanning on another mirror surfaces so as to form an electrostatic latent image of a mirror surface specifying pattern capable of specifying a reference portion formed in the scanning on the one mirror surface, and controls to execute the two-dimensional exposure at a predetermined relative position with respect to the mirror surface specifying pattern with a predetermined clock characteristic so as to form an electrostatic latent image of a detection pattern for detecting the shift, and the correcting specifies a mirror surface used for formation of each portion of the detection pattern from a positional relationship between the reference portion and the detection pattern on the basis of a reading result of a recording medium on which a test chart is formed, the test chart being obtained by developing the electrostatic latent image of the mirror surface specifying pattern and the detection pattern, and detects and corrects the shift related to each of the plurality of mirror surfaces on the basis of a specifying result of the mirror surface and the detection pattern.

8. A non-transitory recording medium storing a computer readable program causing a computer in an image forming apparatus including: a photoreceptor; a light source; a rotational polygon mirror including a plurality of mirror surfaces on an outer circumferential surface of a rotating body that rotates around a predetermined rotation axis and being provided to achieve a configuration to execute sequential primary scanning in which a light beam is emitted from the light source to the rotating outer circumferential surface, and the light beam reflected on each of the plurality of mirror surfaces sequentially scans over a surface of the photoreceptor in a predetermined primary scanning direction; and a clock characteristic changer capable of changing a clock characteristic including at least one of frequency and phase of a write clock used for the scanning, to function as a hardware processor that controls the light source to perform emission of the light beam modulated on the basis of image data in accordance with the write clock, controls to rotate the rotational polygon mirror to perform the sequential primary scanning with the modulated light beam while moving the surface of the charged photoreceptor in a secondary scanning direction intersecting the primary scanning direction so as to control to execute two-dimensional exposure of the surface of the photoreceptor to form an electrostatic latent image of an image related to the image data, and corrects a shift of an exposure position of the light beam arising in accordance with a state of each of the plurality of mirror surfaces, wherein the hardware processor controls to execute the two-dimensional exposure with the clock characteristic of the write clock used for the scanning on one mirror surface among the plurality of mirror surfaces differentiated from the clock characteristic of the write clock used for the scanning on anther mirror surfaces so as to form an electrostatic latent image of a mirror surface specifying pattern capable of specifying a reference portion formed in the scanning over the one mirror surface, controls to execute the two-dimensional exposure at a predetermined relative position with respect to the mirror surface specifying pattern with a predetermined clock characteristic so as to form an electrostatic latent image of a detection pattern for detecting the shift, and specifies a mirror surface used for formation of each portion of the detection pattern from a positional relationship between the reference portion and the detection pattern on the basis of a reading result of a recording medium on which a test chart is formed, the test chart being obtained by developing the electrostatic latent image of the mirror surface specifying pattern and the detection pattern, and detects and corrects the shift related to each of the plurality of mirror surfaces on the basis of a specifying result of the mirror surface and the detection pattern.

9. A method of manufacturing a test chart formation medium being a recording medium on which a test chart is formed, implemented by an image forming apparatus including: a photoreceptor; a light source; a rotational polygon mirror including a plurality of mirror surfaces on an outer circumferential surface of a rotating body that rotates around a predetermined rotation axis and being provided to achieve a configuration to execute sequential primary scanning in which a light beam is emitted from the light source to the rotating outer circumferential surface, and the light beam reflected on each of the plurality of mirror surfaces sequentially scans over a surface of the photoreceptor in a predetermined primary scanning direction; and a clock characteristic changer capable of changing a clock characteristic including at least one of frequency and phase of a write clock used for the scanning, the method comprising:

controlling the light source to perform emission of the light beam modulated on the basis of image data in accordance with the write clock; and controlling exposure to rotate the rotational polygon mirror to perform the sequential primary scanning with the modulated light beam while moving the surface of the charged photoreceptor in a secondary scanning direction intersecting the primary scanning direction so as to control to execute two-dimensional exposure of the surface of the photoreceptor to form an electrostatic latent image of an image related to the image data, wherein the controlling of exposure controls to execute the two-dimensional exposure with the clock characteristic of the write clock used for the scanning on one mirror surface among the plurality of mirror surfaces differentiated from the clock characteristic of the write clock used for the scanning on another mirror surfaces so as to form an electrostatic latent image of a mirror surface specifying pattern capable of specifying a reference portion formed in the scanning over the one mirror surface, and controls to execute the two-dimensional exposure at a predetermined relative position with respect to the mirror surface specifying pattern with a predetermined clock characteristic so as to form an electrostatic latent image of a detection pattern for detecting the shift, and the manufacturing method includes forming an image to transfer an image obtained by developing the electrostatic latent image of the mirror surface specifying pattern and the detection pattern onto the recording medium so as to form a test chart including the mirror surface specifying pattern and the detection pattern.

* * * * *